United States Patent [19]

Pearey

[11] 4,272,129

[45] Jun. 9, 1981

[54] MINERAL MINING INSTALLATION

[75] Inventor: John T. Pearey, Darrington, England

[73] Assignee: Coal Industry (Patents) Limited, London, England

[21] Appl. No.: 55,283

[22] Filed: Jul. 5, 1979

[30] Foreign Application Priority Data

Jul. 14, 1978 [GB] United Kingdom ..... 29859/78

[51] Int. Cl.[3] ..... E21C 29/00

[52] U.S. Cl. ..... 299/31; 299/43; 299/33; 405/293

[58] Field of Search ..... 299/11, 31, 33, 43; 405/93–95

[56] References Cited

U.S. PATENT DOCUMENTS

| | | | |
|---|---|---|---|
| 3,280,570 | 10/1966 | Pollard | 299/31 X |
| 3,471,201 | 10/1969 | Small | 299/31 |
| 3,879,088 | 4/1975 | Sodder et al. | 299/31 |
| 4,029,361 | 6/1977 | Beckmann et al. | 299/31 |
| 4,065,929 | 1/1978 | Simpson | 299/11 X |
| 4,067,618 | 1/1978 | Nakajima et al. | 299/43 X |
| 4,072,355 | 2/1978 | Pentith | 299/43 |
| 4,089,181 | 5/1978 | Koppers | 299/11 |
| 4,155,676 | 5/1979 | Friedrichs | 405/293 |

FOREIGN PATENT DOCUMENTS

| | | |
|---|---|---|
| 998059 | 7/1965 | United Kingdom . |
| 1208198 | 10/1970 | United Kingdom . |

*Primary Examiner*—Ernest R. Purser

*Attorney, Agent, or Firm*—Stevens, Davis, Miller & Mosher

[57] ABSTRACT

A mining installation includes a mine roof support the base of which has a forward part on which is located an elevated track on which a mining machine can be supported for reciprocal movement. A conveyor is disposed beneath the cantilever track for the receipt of mined mineral, but does not bear any of the weight of the machine. The support element has utility supply conduits for use at any location along a mineral face. The installation can be used in thick seams working on the retreat principle and for seams of the order of 8 m can be provided with a rear section also having an elevated support track for supporting a machine capable of taking a substantial roof cut in the wake of the forward section.

21 Claims, 2 Drawing Figures

MINERAL MINING INSTALLATION

This invention relates to a mineral mining installation and a method of working therefor.

Conventional coal mining installations employ an armored flexible conveyor arranged to rest on the seam floor adjacent the face from which material is to be won. A mineral mining machine is mounted directly on top of the conveyor for reciprocal movement therealong and is guided by the conveyor during its passage along the face. The won mineral is loaded on to the conveyor by the machine or specially designed attachments to it, for example cowls or dozer plates. When one strip of coal has been removed from the face, the conveyor is advanced further into the seam to lie alongside the freshly exposed face, such advance being effected by a suitable mechanism, usually in the form of a ram, forming part of or being attached to a support assembly provided for supporting the roof of the seam. By appropriate interaction between the support assembly and the conveyor, a self advancing facility is realized for the support and this is a common feature in modern coal mines. Because of regulations regarding roof support and the desirable objective of achieving a continuous mining situation on a longwall principle, the conveyor and support assemblies of which there are many along the coal face, are generally advanced in the wake of the mining machine when this is feasible.

As a result the conveyor undergoes 'snaking' and is articulated for this purpose. A disadvantage attendant upon this aspect of advance is the tendency for misalignment of the conveyor and therefore of the guiding path for the mining machine. Furthermore, since the machine is supported directly on the top of the conveyor, this latter has to be of a construction rather more robust than would otherwise be necessary. Additionally, the mining machines have to be provided with underframes to enable the machines to run on the conveyor and these can contribute considerably to the overall cost of the machine.

An object of the present invention is to provide a new type of mining installation suitable for thick seams which will constitute a departure from conventional practice. A further object of the invention is the provision of an installation wherein, during the winning operation substantially all the working area is protected from the surrounding environment.

According to a first aspect of the invention a mineral mining installation includes a self advancing roof support unit having a roof-engaging member and a floor-engaging member, the floor-engaging member having a forward part on which is adapted to be mounted a machine supporting element elevated above the level of the said forward part, the element being provided with means for supporting and guiding a mineral mining machine, and a conveyor receiving area defined beneath the machine supporting element and adapted to locate a conveyor.

Conveniently the self advancing roof support unit is of the chock shield type and may have four support legs arranged in pairs fore and aft of the unit, a travelling area being formed therebetween. This travelling area in the installation of the invention may advantageously be provided with a track for the support and guidance of, for example, supplies, vehicles or the like. Sufficient space would also be provided for operatives travelling in use along the face installation. The roof supporting member will have as is usual with support units of the type indicated, a lemniscate shield assembly at the rear of the unit for protecting, in use, the working areas in advance thereof from roof material which breaks off in the wake of the advancing support.

The roof supporting member may also possess in its forward part a face sprag assembly operable from a stowed position adjacent the member to a face supporting position in which a plate forming part of the sprag assembly is held preferably by means of a fluid ram in abutment with the face. In this condition the installation of the invention affords a protective enclosure wherein substantially all of the surrounding mineral environment is shielded. In operation, prior to passage of a mineral mining machine, the sprag assembly would be returned preferably automatically; after passage of the machine, the assembly would be reactivated to support the face.

The machine supporting element mounted on a forward part of the floor-engaging member of the roof support unit may conveniently be in the form of a cantilever, the upright arm of which is attached to said forward part; the supporting portion of the element extends horizontally or substantially horizontally forwardly and has on its relatively upper surface the means for supporting and guiding the machine. These means may be in the form of a track with which shoes or other components on the machine are adapted to engage.

The upright arm of the supporting elements may conveniently contain facilities for the supply of utility fluids for use in equipment deployed along the face and comprising a plurality of the present invention. For example, hydraulic oil for the fluid operable components of the installation, and water for dust suppression equipment which may advantageously be located on the mining machine. The provision of a water supply along the whole length of the face offers the possibility of utilizing water for other functions. For example, the supply through the face could be used for fire fighting purposes should the need arise, and for frictional ignitions. In this latter respect, blanket dowsing by water of the face area could readily be achieved by this through - face arrangement.

The supporting element may incorporate its own independent reservoir of working fluid, i.e. hydraulic fluid. A hydraulic pump may also be provided thereby rendering each unit independent of a main supply should the need arise.

The machine supporting element may also have an electrical supply in the form of a busbar arrangement, a pantograph pick-up being provided on the machine for picking up the electrical power in use. There may also be located on the element a water supply fed from the utility source, the water supply being in the form of a duct with an automatically self sealing inlet through which a pick-up from the machine may extend. These arrangements obviate the need for trailing cables or hoses. However, it is within the scope of the invention to provide means for supplying utilities to the machine via such trailing cables.

The machine supporting element may also include a dust extraction unit in the form of a duct provided with openings for the ingress into the duct of dust laden air. The openings may have shutters which can be selectively opened and closed depending upon, in use, the location of the dust source. For example, the shutters would be adapted, in use, to open when the mineral mining machine came into the appropriate vicinity, and close again after its passage. A control mechanism may be arranged sequentially to activate the shutters dependent upon the movement and location of the machine. A fan is provided at a suitable location.

A coal breaker may be provided and may conveniently be mounted on the machine supporting element. In one embodiment, the coal breaker of the rotary type is disposed with the breaker roller axes horizontal. The drive for the coal breaker would thus be located on the vertical arm of the supporting element and may advantageously be operable at varying heights within the conveyor receiving area. In a further embodiment, the coal breaker roller axes are disposed vertically in which case the drive for the roller is mounted in the cantilever arm of the machine supporting element.

Below the machine supporting element is the conveyor receiving area in which is located a conveyor. It will be understood that each support unit would be provided with a conveyor section or pan, so that a plurality of the pans would constitute a unitary conveyor. The conveyor is preferably of the armored flexible type and would be so positioned as to receive mined mineral directly. In view of the elevated feature of the machine supporting element an unobstructed path for the mineral onto the conveyor is achieved.

The forward part of the floor-engaging member of the support unit on which the machine supporting element is located is conveniently movable in relation to the rest of the floor engaging member and movement may be effected by a fluid operable ram or other means.

Each support unit has a self advancing feature which in one embodiment may include at least one rack and pinion assembly, a fluid operable drive unit for the pinion being provided. The rack and pinion assemblies on adjacent support units are adapted to interact to effect the requisite relative motion between one support and another. In an alternative embodiment, conventional self-advancing means may be employed.

According to another aspect of the invention, a face system includes a plurality of the mineral mining installations of the first aspect in which adjacent installations are so arranged that the machine supporting elements are in alignment to provide a continuous support for the machine, a conveyor is located in the conveyor receiving area and at least one mineral mining machine is mounted for reciprocal movement along and supported by the elements.

The mineral mining machine conveniently has more than one cutting head and is of the shearer loader type. Advantageously, especially for thick seam working an array of four heads may be provided.

The drive means for the mining machine may be fluid operable and may include a pinion engageable with a rack arranged on the machine supporting element.

In use, the steering of the machine may be effected dependent upon the monitoring of face alignment. This alignment may be achieved by utilizing a laser beam focussed onto an appropriate target on the machine supporting element, the laser beam source being positioned at the end of the face in a roadway leading thereto. Alteration of the position of the machine body to take account of any misalignment may be effected by ranging the machine using fluid operable means. The fluid operable means are conveniently in the form of jacks actuable to vary the pitch and/or roll of the machine body in order to achieve the requisite horizon control.

In an alternative form of the invention, the rearward part of the support unit is modified to accommodate a further machine supporting element elevated above the level of the floor engaging member. A conveyor is disposed beneath the element for receiving mineral cut by a winning machine in use arranged for reciprocal movement along the element. The winning machine may be of the double-ended ranging drum shearer type. This machine may be modified to carry two drums on each of its ranging arms. The cutting drums of such a machine in this type of installation mounted on the rearward supporting element would have the task of cutting the top coal above the section previously extracted by the machine on the forward part of the roof support unit. This allows a large seam section to be extracted in virtually one unitary operation as the lower and upper seam benches are removed in tandem. It is envisaged that seam thicknesses of the order of 8 meters could readily be extracted. At present, in certain areas of the world, such thick seams are workable but usually by extraction of a lower bench and shot firing the top coal to give what is known as sub-level caving. This latter operation is highly dangerous in view of the possibility of natural caving once the lower section has been removed. In addition in view of the considerable height at which the men have to work to drill the shot holes, the potential danger of injury to personnel is great. Furthermore, the mining operation at the lower bench level is delayed until the top coal has been brought down. This is obviously inefficient.

The alternative embodiment obviates the potential danger to personnel as the operatives, as with the first embodiment, are totally protected within the support unit. It is envisioned that the present invention, especially the alternative embodiment, will have particular application in retreat mining operations where the roadways are preformed and thus problems of support in this respect as mining proceeds are reduced or obviated. With thick seams, particularly, retreat mining is economically attractive, and the present invention affords the opportunity of taking full advantage of this potential by providing the requisite technological means.

By way of example only, two embodiments of a mineral mining installation according to the invention are described below with reference to the accompanying drawings.

Figure 1:
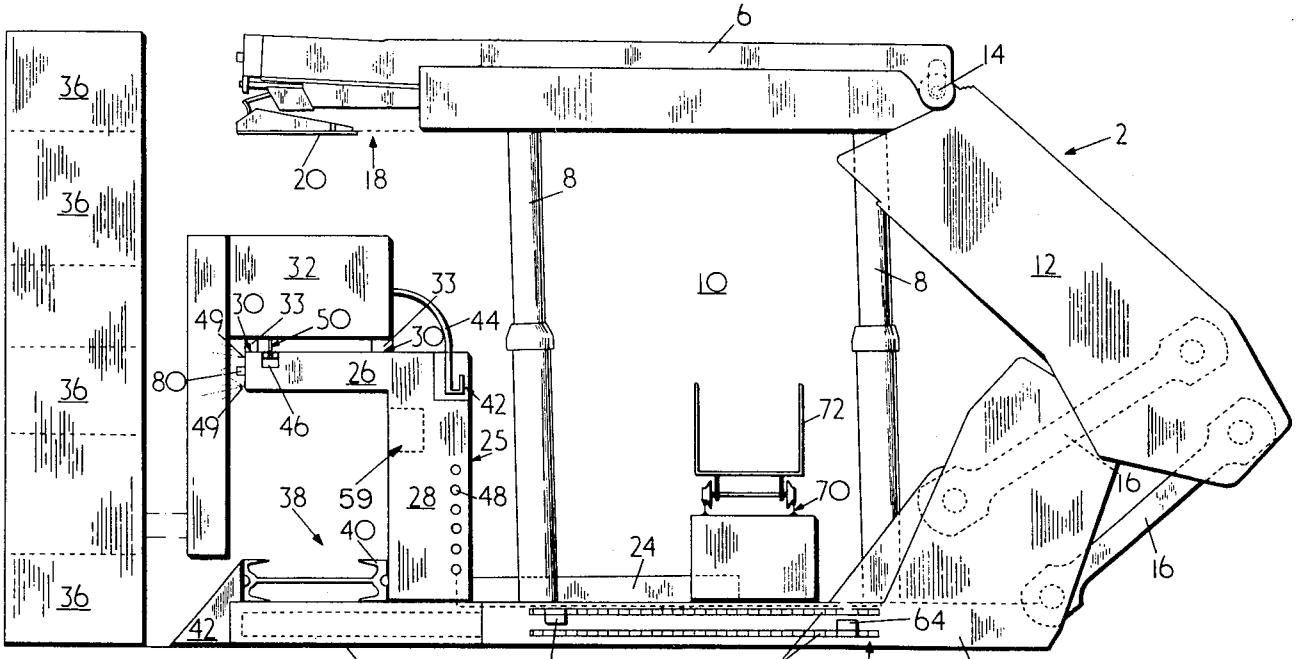
FIG. 1 is a side view of a first embodiment.

Referring to FIG. 1 of the drawings there is depicted a mineral mining installation including a chock shield support unit 2 having a floor-engaging base 4 and a roof-engaging beam 6 supported by four hydraulically operable supports 8 (only two of which are shown) spaced apart in pairs fore and aft to define an access travelling way 10. A shield 12 is pivotally attached at 14, to the roof beam 6 and is connected by lemniscate linkages 16 to the base 4. The roof beam 6 also carries at its front end a face sprag assembly 18 including a contact plate 20 which is shown in a stowed position adjacent the beam 6. In a face supporting mode, the plate 20 is extended from its stowed position by suitable means (not shown) to a position whereat it abuts a part of the face.

The base 4 has a forward part 22 which is movable in relation to the remainder thereof by means of a fluid operable ram 24 and carries a machine supporting element 25 in the form of a cantilever arm 26 supported by an upright arm 28. The arm 26 is provided with a track 30 which supports and guides a mineral mining machine 32 which has a plurality of cutting heads shown diagrammatically at 36. The machine 32 has shoes 33 which may incorporate hydraulic jacks (not shown) for ranging the machine to give a variable pitch and roll facility for horizon control. The cantilever arm 26 is elevated above the forward part 22 and defines beneath it a conveyor receiving area 38 in which is located a conveyor 40 having a ramp plate 42.

The machine supporting element 25 may have a rack (not shown) extending therealong conveniently on the arm 26, a drive pinion on the machine 32 being engageable therewith. The element 25 also provides a utility supply facility for electrical and fluid power. In particular, an electrical bus bar supply 42 is provided in the top of the arm 26 and has a self sealing access arrangement (not shown) for a pick-up arm or pantograph 44 which extends from the machine 32 as shown. In addition, a water conduit 46 supplied, in use, from a manifold 48 extending the length of the installation is located on the face side of the arm 26. A pick-up arm 50 extends from the machine 32 into the water conduit 46 to take up the supply for direction to sprays (not shown) on the machine. Sprays 49 on the arm 26 are also fed with water and the issuing spray is directed towards the zone where dust generation is taking place.

A dust extraction system generally indicated at 59 is incorporated in the upright arm 28 and has a plurality of openings (not shown) closeable by means of shutters (not shown) which in use are opened and closed sequentially dependent upon the machine's position on the installation. The shutters are opened when passage of the machine is imminent and when it takes place so that dust generated by the cutting action of the heads 36 is extracted along the face but is isolated from the atmosphere. The extraction equipment incorporating a fan (not shown) would be located at the end of the face in a roadway.

The base 4 to which reference has already been made also incorporates an advancing assembly 60 for advancing adjacent supports 2. The assembly 60 comprises a pair of racks 62 on each side of the base 4 with which a fluid operable drive unit 64 is co-operable to effect relative movement between adjacent supports 2.

The access travelling way 10 may in use accommodate a track 70 for a rail-mounted vehicle 72 which could carry supplies or men (not shown) along the length of the face system which is constituted by a plurality of the supports 2 mounted along a coal face for example.

In use, the mineral mining machine 32 travels along its track 30 by means of a pinion engaging a rack (not shown) mounted on the arm 26. The cutting horizon and the alignment of the arm 26 and thus the track is monitored by a laser beam focussed on a target 80 on the arm 26. Any deviation from the desired cutting line is detected and corrective action taken either automatically by means of radio signals and servo mechanism or manually by an operative scanning the monitoring function. The power and water supplies disclosed in this embodiment obviate the need for trailing cables and hoses thereby removing a source of hazard and potential damage.

By virtue of the elevation of the machine 32 above the conveyor 40, there is substantially no weight on the conveyor save for the mineral deposited thereon during and/or subsequent to the cutting run of the machine. Access to the conveyor for the cut mineral is also enhanced by virtue of the cantilever character of the arm 26. It will however be understood that a cantilever arrangement along the whole length of a coal face for the supporting element may be provided with strengthening members and supports which may be located at spaced intervals along the face.

The supports 2 are advanced when required by utilizing the rack and pinion advancing assemblies 60 in sequential fashion and in the usual way subsequent to conveyor advance and retraction of the supports 8. With regard to conveyor advance, it is envisaged that at least at the ends of a face, it may be necessary to sump over the machine to cut into the end of the coal face to provide a start for the next cutting run. This is facilitates by the telescopic nature of the forward part 22 of the base 4. With regard to conveyor advance, it is envisaged that the forward parts of the supports carrying the elevated track and the conveyor will be advanced in blocks along the length of the face. Thus, for example a 50 m. length may be advanced en bloc and the support units then advanced in its wake and reset to the roof. The next 50 m length could then be advanced in the same fashion and so on along the whole of the face. In addition at each end of the face, it may be necessary to sump over the machine to cut into the end of the coal face to provide a start for the next cutting run. In this regard, it may be necessary to cantilever the elevated track at its ends not only towards the face but also parallel thereto in order to give the flexibility of maneuver for the machine in these areas. Adjacent conveyor sections and indeed machine supporting element sections may be provided with articulated connections allowing limited relative movement. These connections could be in the form of ball and socket joints, but other connections performing an equivalent function could be employed.

A face system comprises a plurality of the installations of the present invention and thus a system of modules, each provided with full working facilities including for example tap-in sections for the utility supplies. The invention thus lends a flexibility to face design while affording almost total enclosure of the working environment, the appearance of the surrounding environment taking place virtually only when coal is actually being mined in the relevant zone.

Figure 2:
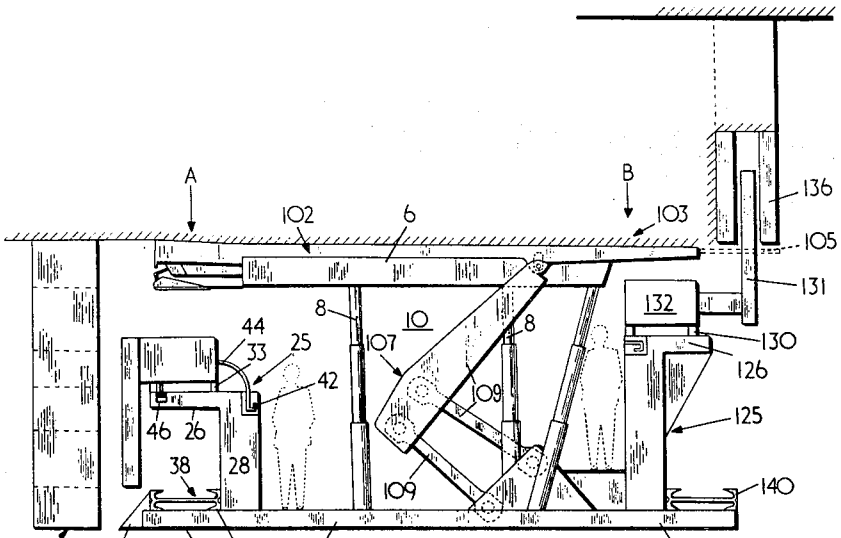
FIG. 2 is a side view of a second embodiment.

Referring now to FIG. 2, the second embodiment of the invention includes a forward section and a rearward section which essentially mirror each other as can be seen from the drawing. The forward section designated A comprises all the elements disclosed in relation to the corresponding forward section of FIG. 1 and while they bear the same reference numerals, they will not be described again.

The rearward section B is integral and shares a support unit 102 with section A. The roof beam 6 of the unit 102 includes a rear cantilever 103 which is provided with a rear extension bar 105. The bar 105 is retractable within the cantilever 103 and may in alternative embodiments be arcuate in side elevation so that in the event of any unplanned caving, no flushing into the working area can occur.

The support also possesses a lemniscate assembly 107 which is located inboard as opposed to the outboard arrangement shown in FIG. 1. In the second embodiment the assembly 107 comprises plate links 109. The floor-engaging base 104 has a rear extension 106 on which is affixed a machine supporting element 125 in the form of a cantilever arm 126 directed rearwardly of the unit 102 and supported by an upright arm 128. The cantilever arm 126 is disposed at a higher level than the cantilever arm 26 on forward section A and has a track 130 on its upper surface for supporting and guiding a mineral mining machine 132 which is of the double ended ranging drum shearer type modified so that both of its ranging arms 131 can carry two cutting heads 136 which may be mounted on the ranging arms 131 via further ranging arms (not shown). The machine 132 may be propelled along the track 130 in the same manner as the machine 32 and accordingly similar equipment is provided for this purpose and for the other utilities already described in relation to FIG. 1. A conveyor 140 is provided beneath arm 126 for receiving and conveying coal won by machine 132.

In operation of the second embodiment, all the equipment would be located in a thick seam, for example 8 m working on a retreat method with the section A leading section B. Section A is arranged such that its machine 32 extracts say 4½ m of the total seam thickness while the machine 132 of Section B removes the remaining 3½ m say of the seam in the wake of machine 32 but in tandem therewith. As indicated in the drawing, the top coal may be removed in benches.

The advance of the forward section A can be effected independently, as described in relation to FIG. 1, by advancing the forward parts 22 in relation to the support units. The rearward section B will move forward when the top coal has been removed and since it is carried by the support base via the arms 125, 126 it is advanced as the support unit moves forward. In an alternative embodiment, a telescopic arrangement for the base in the section B similar to that for the forward section A could be provided to allow the machine 132 to lag behind the machine 32 somewhat if that is required. In practice, it is thought, however, that this will generally not be required.

By utilizing the second embodiment, the same advantages regarding the removal of conveyor loading by the machine are realized in the front and rearward sections. In addition, thick seams can be extracted with a maximum of mechanization with protection for the face operatives. Greater efficiency than could be obtained by sub-level caving will also be realized with a concomitant improvement in the economic viability of the winning operation.

It is envisaged that the invention will have particular relevance to retreat working and as far as the second embodiment is concerned to thick seams using this extraction method.

The invention can be used for mining using the longwall principle but it also lends itself to shortwall mining. This can be appreciated because of the essentially unitary character of the equipment assembly which can be operated as a module or a small number of modules over a short face.

The present invention thus provides a degree of versatility and efficacy hitherto unknown in the mining field and constitutes a significant departure from existing practice.

I claim:

1. A mineral mining installation including a self-advancing roof support having a roof-engaging member and a floor-engaging member, wherein the floor-engaging member has a forward part and a rearward part, the forward part being movable relative to the rearward part, a machine supporting element mounted on said forward part at an elevated level above the level of the said forward part, means for supporting and guiding a mineral mining machine on the machine supporting element, and a conveyor receiving area defined beneath the machine supporting element and adapted to locate a conveyor.

2. An installation according to claim 1 in which the self advancing support unit is of the chock shield type incorporating a lemniscate assembly at the rear thereof.

3. An installation according to claim 2 in which the support unit has four support legs arranged in pairs fore and aft of the unit, a travelling area being formed therebetween.

4. An installation according to claim 3 in which a track is provided in the travelling area.

5. An installation according to claim 1 in which the roof supporting member has a forward part, and a face sprag assembly is located in said forward part and is operable from a stowed position adjacent the member to a face supporting position.

6. An installation according to claim 1 in which the machine supporting element is in the form of an upstanding cantilever, the upright arm of which is attached to said forward part.

7. An installation according to claim 6 in which a supporting portion of the cantilever extends horizontally forwardly of the support unit and has a relatively upper surface which provides the means for supporting and guiding the machine.

8. An installation according to claim 7 in which the means is a track, and shoes are provided on a mineral mining machine for engagement therewith.

9. An installation according to claim 1 in which the supporting element contains facilities for the supply in operation of the installation of utility fluids.

10. An installation according to claim 9 in which a water circuit is provided.

11. An installation according to claim 10 in which outlets for the water circuit are provided.

12. An installation according to claim 1 in which the machine supporting element is provided with an electrical supply facility.

13. An installation according to claim 12 in which the electrical supply facility is a bus bar arrangement, a pantograph pick-up arm being provided on the mineral mining machine.

14. An installation according to claim 1 in which a dust extraction duct is incorporated in the machine supporting element.

15. An installation according to claim 1 in which the movement of the forward part relative to the rearward part thereof of the floor-engaging member is effected by a fluid operable ram.

16. An installation according to claim 1 in which the support unit has a self advancing means in the form of a rack and pinion assembly, a fluid operable drive being provided for the pinions.

17. An installation according to claim 1 in which the rearward part of the floor-engaging member has a further machine supporting element mounted thereon at an elevated level above the level of the floor-engaging member, a further machine being supportable on said element.

18. An installation according to claim 17 in which the further machine supporting element is at a higher level than the first mentioned machine supporting element.

19. A face system including a plurality of the mineral mining installations claimed in claim 1 in which adjacent installations are so arranged that the machine supporting elements are aligned to provide a continuous support for the machine, a conveyor is located in the conveyor receiving areas and at least one mineral mining machine is mounted for reciprocal movement along and supported by the elements.

20. A face system according to claim 19 in which each mineral mining machine is of the shearer loaden type.

21. A face system according to claim 20 in which each machine includes an array of four cutting heads.

* * * * *